US008112840B2

(12) United States Patent
Chen et al.

(10) Patent No.: US 8,112,840 B2
(45) Date of Patent: Feb. 14, 2012

(54) DISC ROTATING AND POSITIONING STRUCTURE OF A MOP

(75) Inventors: Yung-Hua Chen, Lujhou (TW); Chin-Yang Shin, Gueishan Township, Taoyuan County (TW)

(73) Assignee: Tuo Shen International Corporation Limited, Taoyuan County (TW)

( * ) Notice: Subject to any disclaimer, the term of this patent is extended or adjusted under 35 U.S.C. 154(b) by 427 days.

(21) Appl. No.: 12/458,129

(22) Filed: Jul. 1, 2009

(65) Prior Publication Data

US 2011/0000043 A1 Jan. 6, 2011

(51) Int. Cl.
*A47L 13/20* (2006.01)

(52) U.S. Cl. ..... 15/229.6; 15/147.1; 15/229.1; 15/229.2; 15/228

(58) Field of Classification Search ..... 15/229.6, 15/229.2, 229.1, 228, 147
See application file for complete search history.

(56) References Cited

U.S. PATENT DOCUMENTS

| | | | | |
|---|---|---|---|---|
| 1,091,700 | A * | 3/1914 | Pirrung | 401/288 |
| 4,794,663 | A * | 1/1989 | Vosbikian | 15/229.6 |
| 8,032,975 | B2 * | 10/2011 | Chiang | 15/229.6 |
| 2010/0242200 | A1 * | 9/2010 | Chen | 15/229.6 |

* cited by examiner

*Primary Examiner* — Robert Scruggs
(74) *Attorney, Agent, or Firm* — Rosenberg, Klein & Lee

(57) ABSTRACT

A disc rotating and positioning structure of a mop including a mop head, a mop rod, a pivotal base, a positioning device, a locking device and a bolt. When the mop is dewatered, the mop rod is in an erect position, such that a semicircular cam of the bolt faces upward to drive the locking device to press the disc upward and into a locked and linking status, and when the mop is used for mopping, the mop rod is in an inclined position to drive the semicircular cam of the bolt to shift to a side, such that the locking device is in a non-pressing status with respect to the disc, and a force is applied to rotate the mop head when the mop is used for mopping a floor. Therefore, the present invention can provide a convenient operation and a user-friendly application.

4 Claims, 4 Drawing Sheets

DISC ROTATING AND POSITIONING STRUCTURE OF A MOP

BACKGROUND OF THE INVENTION

1. Field of the Invention

The present invention relates to a disc rotating and positioning structure of a mop, in particular to a structure capable of fixing a disc with an internal rod when the mop is dewatered at an erected position, and rotating the disc in 360 degrees with respect to the mop rod when the mop is used for mopping floor at an inclined position.

2. Description of the Related Art

After a mop has been used, it is necessary to wring dirty water from mop fabrics (or cotton strips) of the mop before soaking clean water again to facilitate washing a floor, and mopping is obviously a tiresome job. Therefore, related manufacturers have developed various different dewatering devices for the mop, such as a dewatering device disclosed in R.O.C. Pat. No. 347146, wherein a pedal is provided for driving a gear to rotate a dewatering tank at a fast speed, so as to wring cotton strips of the mop placed in the dewatering tank. Although the aforementioned device can improve the inconvenient way of wringing the mop fabrics by hands, yet the operation still requires a user to step on the pedal continuously by one foot, and keep the user's body in balance by another foot. Such arrangement not only involves an inconvenient operation, but also endangers the safety of users when the users fail to stand stably or fall. Furthermore, the mop is rotated in 360 degrees, and thus a mop head disc with cotton strips requires a structure that can be rotated together with the mop rod.

When the cotton strips of the mop are soaked with liquid in a saturated state, it is necessary to put the mop head into the dewatering tank and drive a transmission mechanism in the dewatering tank to rotate the dewatering tank by 360 degrees and drive the mop head placed in the dewatering tank to rotate 360 degrees synchronously in order to wring the mop.

However, the foregoing way of wringing water from the mop head by stepping the pedal requires devices with a complicated structure, and users step on the pedal by one foot and stand stably and keep their body in balance by another foot. There is a potential risk of falling down easily during the operation of wringing the mop.

In view of the shortcomings of the prior art that dewaters a mop head by driving a dewatering tank to rotate passively without using a driving mechanism and causes inconvenience and safety issues, the inventor of the present invention provides a solution to overcome the shortcomings of the prior art. Since the mop head can be rotated in 360 degrees while the mop is being used for mopping floor, the mop head is driven by a mop rod when the mop head is wrung. Now, the mop head is fixed with the mop rod and moved together with the mop rod accordingly. This arrangement is different from the aforementioned conventional mops, wherein the mop head can be rotated in 360 degrees during a mopping process and fixed with the mop rod automatically during a dewatering and wringing process.

SUMMARY OF THE INVENTION

Therefore, it is a primary object of the present invention to provide a disc rotating and positioning structure of a mop that can mop and clean a floor without using any additional tool, and the mop head can be rotated in 360 degrees with respect to the mop rod to achieve a convenient cleaning effect. In addition, a special design of a positioning structure allows the mop head to be fixed and linked with the mop rod automatically and driven by the mop rod to wring the mop head, so as to achieve the effects of a convenient operation and a user-friendly application.

In order to achieve the above-mentioned object, the invention includes:

a) a mop head, including a disc, a plurality of cotton strips disposed at a bottom periphery of the disc, and a circular hole disposed at the center of the disc;

b) a mop rod, having a bottom provided for connecting the mop head;

c) a pivotal base, having an upper section which is a bushing with an opening facing upward, and provided for placing and fixing the bottom of the mop rod, and a lower section which is an n-shaped member having different sized first and second lugs disposed on both sides of the n-shaped member and corresponding to the first and second axial holes respectively;

d) a positioning device, disposed at the top of the circular hole of the disc, and having a first positioning surface greater than the circular hole at the center of the disc, a long slot disposed at the center of the first positioning surface and opposite to the circular hole, a third lug disposed on a side of the long slot and on a surface on the first positioning surface, and a third axial hole disposed thereon and corresponding to the first and second axial holes;

e) a locking device, disposed at the bottom of the circular hole of the disc, and having a second positioning surface, a circular hole disposed on a surface on the second positioning surface and provided for passing the disc, and a fourth lug disposed at the long slot of the positioning device and having a fourth axial hole corresponding to the third axial hole; and f) a bolt, including a semicircular cam disposed on a portion of a bolt pillar, and axially passed through the first, second, third and fourth axial holes of the first, second, third and fourth lugs, such that the third and fourth lugs are pivotally coupled between the first and second lugs to situate the semicircular cam into the fourth lug, and an external side of the bolt is secured to the n-shaped member by a screw, and the bolt is rotated together with the first and second lugs, so as to drive the semicircular cam to push the fourth axial hole of the lug.

When the mop is dewatered, the mop rod is in an erect position, such that the semicircular cam of the bolt faces upward to drive the locking device to press the disc upward and into a locked and linking status. When the mop is used for mopping, the mop rod is in an inclined position to drive the semicircular cam of the bolt to shift to a side, such that the locking device is in a non-pressing status with respect to the disc. As a result, a force is applied to rotate the mop head when the mop is used for mopping a floor.

DETAILED DESCRIPTION OF THE PREFERRED EMBODIMENT

Figure 1:
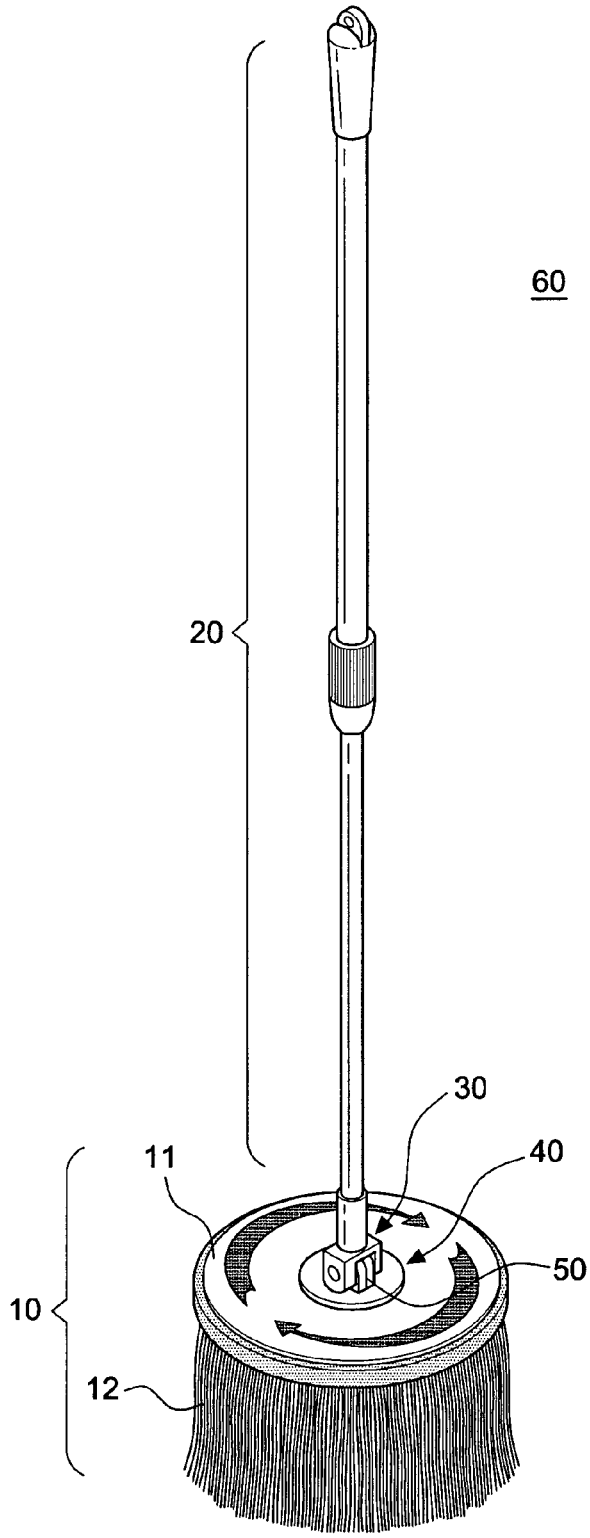
FIG. 1 is a perspective view of a first preferred embodiment of the present invention.
Figure 2:
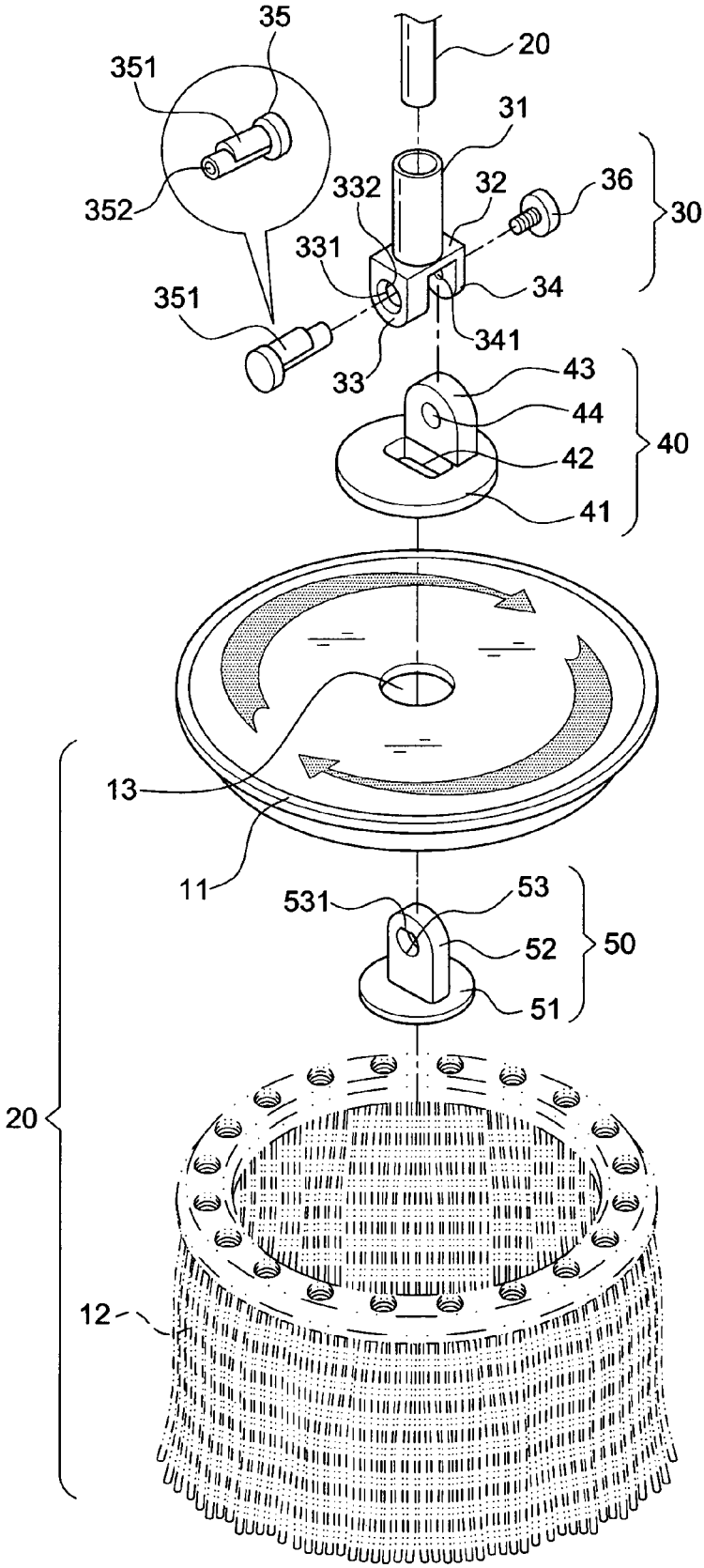
FIG. 2 is an exploded view of a main structure of the present invention.

With reference to FIGS. 1 to 6 for a disc rotating and positioning structure of a mop in accordance with a preferred embodiment of the present invention, the structure comprises the following elements.

A mop head 10 includes a disc 11, a plurality of cotton strips 12 disposed at a bottom periphery of the disc 11, and a circular hole 13 disposed at the center of the disc 11.

A mop rod 20 has a bottom provided for connecting the mop head 10.

A pivotal base 30 includes an upper section which is a bushing 31 with an opening facing upward for placing and fixing the bottom of the mop rod 20, and a lower section which is an n-shaped member 32 having different sized first lug 33 and second lug 34 disposed on both sides of the n-shaped member 32 and corresponding to the first axial hole 331 and the second axial hole 341 respectively.

A positioning device 40 is disposed at the top of the circular hole 13 of the disc 11 and has a first positioning surface 41 greater than the circular hole 13 at the center of the disc 11, a long slot 42 disposed at the center of the first positioning surface 41 and opposite to the circular hole 13, a third lug 43 disposed on a side of the long slot 42 and on a surface on the first positioning surface 41, and a third axial hole 44 disposed thereon and corresponding to the first axial hole 331 and the second axial hole 341.

A locking device 50 is disposed at the bottom of the circular hole 13 of the disc 11 and has a second positioning surface 51, a circular hole 13 disposed on a surface on the second positioning surface 51 and provided for passing the disc 11, a fourth lug 52 disposed at the long slot 42 of the positioning device 40, and a fourth axial hole 53 disposed on the fourth lug 52 and corresponding to the third axial hole 44.

A bolt 35 includes a semicircular cam 351 disposed on a portion of a bolt pillar and axially passed through the first axial hole 331, second axial hole 341, third axial hole 44 and fourth axial hole 53 of the first lug 33, second lug 34, third lug 43 and fourth lug 52, such that the third lug 43 and the fourth lug 52 are pivotally coupled between the first lug 33 and the second lug 34, and the semicircular cam 351 is installed in the fourth lug 52, and an external side of the bolt 35 is secured to the n-shaped member 32 by a screw 36, such that the bolt 35 is rotated together with the first lug 33 and the second lug 34 to drive the semicircular cam 351 to push the fourth axial hole 53 of the fourth lug 52.

The fourth axial hole 53 has a hole diameter greater than the third axial hole 44 for placing and installing the semicircular cam 351 of the bolt 35, and an upper end of the fourth axial hole 53 can be a non-circular plane 531, but not limited to such arrangement only. If the semicircular cam 351 faces upward, the plane 531 is pushed to drive the locking device 50 to shift upwardly.

The first positioning surface 41 of the positioning device 40 and the second positioning surface 51 of the locking device 50 are in a circular shape, and the periphery of the circular hole 13 of the disc 11 constitute a structure for clamping the disc 11 from both upper and lower sides.

The semicircular cam 351 of the bolt 35 has a portion passed through a latch hole 352 with a smaller hole diameter at an internal side of the first axial hole 331 and fixed and linked with the first lug 33.

Figure 3:
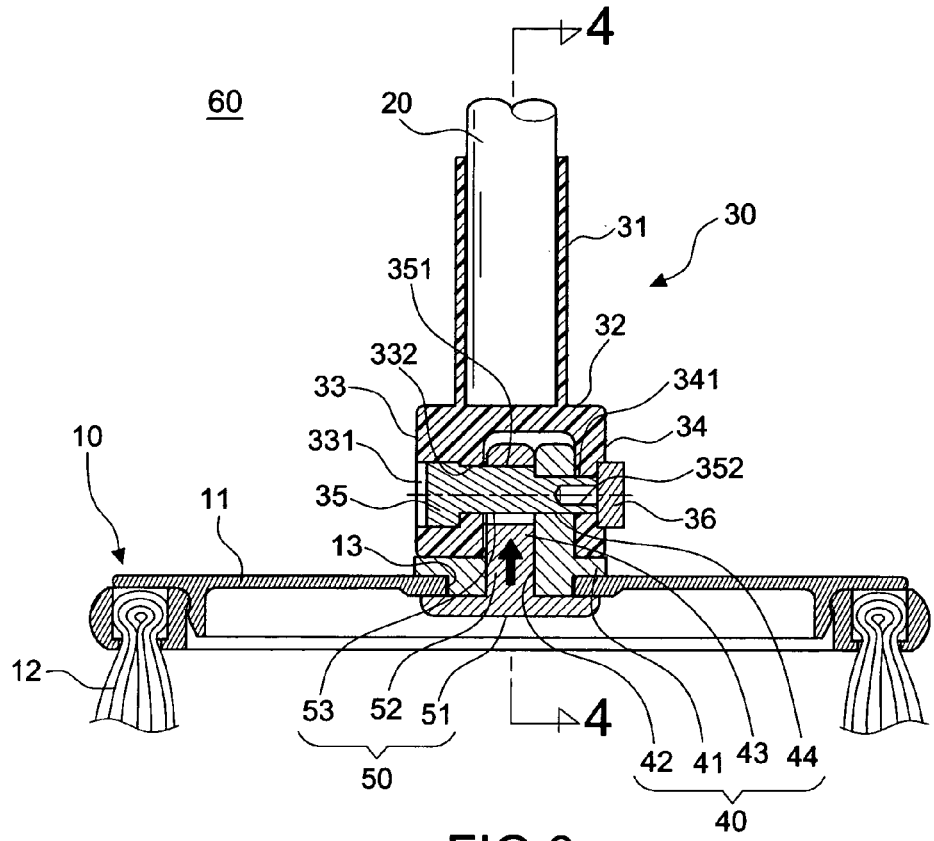
FIG. 3 is a cross-sectional view of a semicircular cam of a bolt facing upward in accordance with the present invention.
Figure 4:
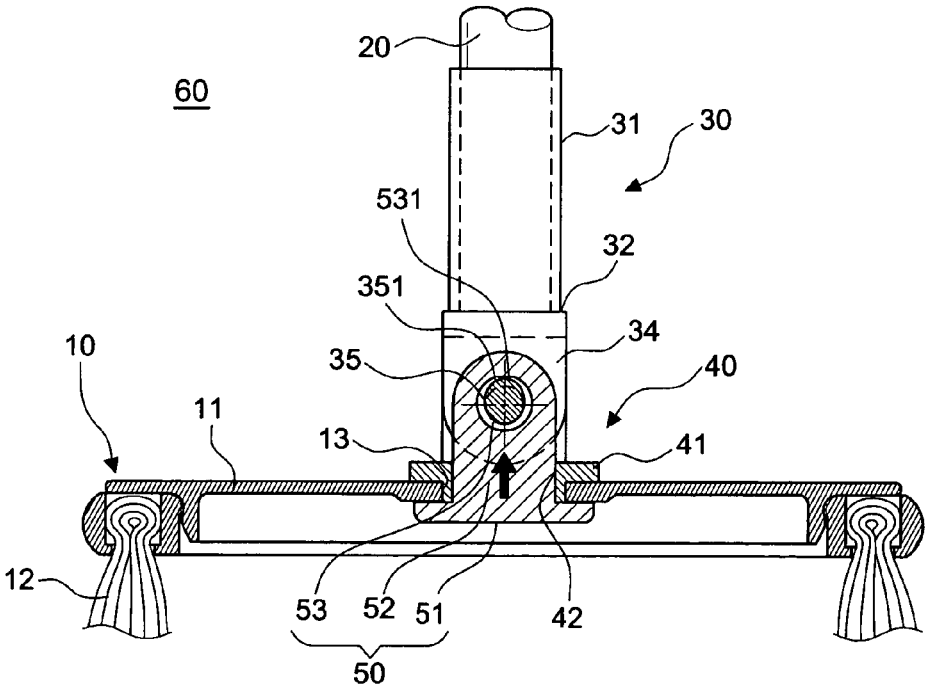
FIG. 4 is a cross-sectional view of Section 4-4 of FIG. 3.
Figure 5:
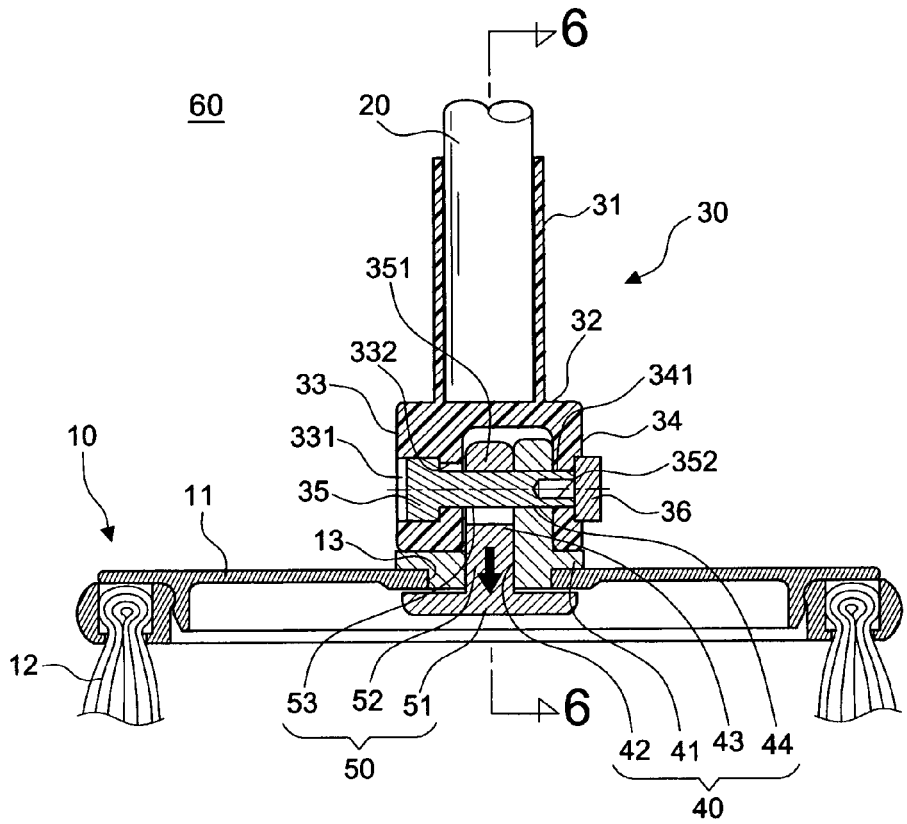
FIG. 5 is a schematic view of shifting a semicircular cam of a bolt in accordance with the present invention.
Figure 6:
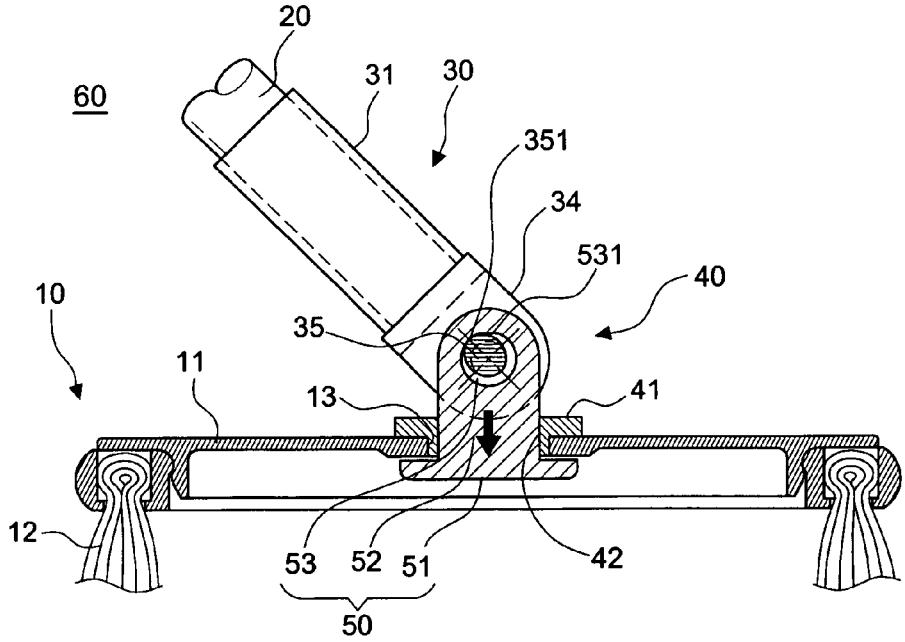
FIG. 6 is a cross-sectional view of Section 6-6 of FIG. 5.

When the mop 60 is dewatered as shown in FIGS. 3 and 4, the mop rod 20 is in an erect position, such that the semicircular cam 351 of the bolt 35 faces upward to drive the locking device 50 to press the disc 11 upward into a locked and linking status. When the mop 60 is used for mopping floor as shown in FIGS. 5 and 6, the mop rod 20 is in an inclined position to drive the semicircular cam 351 of the bolt 35 to shift to a side, such that the locking device 50 is in a non-pressing status with respect to the disc 11, so as to rotate the mop head 10 when a force is applied during the mopping.

With the technical characteristics of the present invention, the mop head 10 can be rotated in 360 degrees with respect to the mop rod 20 without using any additional tool for mopping and cleaning a floor easily, and the mop can reach wall edges and dead corners to make the cleaning job more convenient and easier.

When the mop head 10 is dewatered, the special design of the positioning structure including the mop head 10, mop rod 20, pivotal base 30, positioning device 40, locking device 50 and bolt 35 can fix and link the mop head 10 with the mop rod automatically, and the mop rod can drive the mop head to rotate and wring, so as to achieve a convenient operation and a user-friendly application.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A disc rotating and positioning structure of a mop, comprising:

a) a mop head, including a disc, a plurality of cotton strips disposed at a bottom periphery of the disc, and a circular hole disposed at the center of the disc;

b) a mop rod, having a bottom provided for connecting the mop head;

c) a pivotal base, having an upper section which is a bushing with an opening facing upward, and provided for placing and fixing the bottom of the mop rod, and a lower section which is an n-shaped member having different sized first and second lugs disposed on both sides of the n-shaped member and corresponding to the first and second axial holes respectively;

d) a positioning device, disposed at the top of the circular hole of the disc, and having a first positioning surface greater than the circular hole at the center of the disc, a long slot disposed at the center of the first positioning surface and opposite to the circular hole, a third lug disposed on a side of the long slot and on a surface on the first positioning surface, and a third axial hole disposed thereon and corresponding to first and second axial holes;

e) a locking device, disposed at the bottom of the circular hole of the disc, and having a second positioning surface, a circular hole disposed on a surface on the second positioning surface and provided for passing the disc, and a fourth lug disposed at the long slot of the positioning device and having a fourth axial hole corresponding to the third axial hole; and f) a bolt, including a semicircular cam disposed on a portion of a bolt pillar, and axially passed through the first, second, third and fourth axial holes of the first, second, third and fourth lugs, such that the third and fourth lugs are pivotally coupled between the first and second lugs to situate the semicircular cam into the fourth lug, and an external side of the bolt is secured to the n-shaped member by a screw, and the bolt is rotated together with the first and second lugs, so as to drive the semicircular cam to push the fourth axial hole of the lug, whereby, when the mop is dewatered, the mop rod is in an erect position, such that the semicircular cam of the bolt faces upward to drive the locking device to press the disc upward and into a locked and linking status, and when the mop is used for mopping, the mop rod is in an inclined position to drive the semicircular cam of the bolt to shift to a side, such that the locking device is in a non-pressing status with respect to the disc, and a force is applied to rotate the mop head when the mop is used for mopping a floor.

2. The disc rotating and positioning structure of a mop as recited in claim 1, wherein the fourth axial hole has a hole diameter greater than the third axial hole for placing and installing a semicircular cam of the bolt, and an upper end of the fourth axial hole is a non-circular plane.

3. The disc rotating and positioning structure of a mop as recited in claim 1, wherein the semicircular cam of the bolt has a portion passed through a latch hole with a smaller hole diameter and disposed at an internal side of the first axial hole, such that the semicircular cam is fixed and linked with the first lug.

4. The disc rotating and positioning structure of a mop as recited in claim 1, wherein the first positioning surface of the positioning device and the second positioning surface of the locking device are in a circular shape, and the periphery of the circular hole of the disc forms a structure for clamping the disc from both upper and lower positions.

* * * * *